United States Patent [19]

Garner

[11] 4,006,788

[45] Feb. 8, 1977

[54] DIAMOND CUTTER ROCK BIT WITH PENETRATION LIMITING

[75] Inventor: Lloyd L. Garner, Los Alamitos, Calif.

[73] Assignee: Smith International, Inc., Irvine, Calif.

[22] Filed: June 11, 1975

[21] Appl. No.: 585,975

[52] U.S. Cl. ..... 175/330; 175/336

[51] Int. Cl.[2] ..... E21B 9/36

[58] Field of Search ..... 175/329, 330, 336

[56] References Cited

UNITED STATES PATENTS

| | | | |
|---|---|---|---|
| 1,506,119 | 8/1924 | Hansen | 175/329 |
| 2,049,543 | 8/1936 | Kammerer | 175/336 |
| 2,399,372 | 4/1946 | Metzger et al. | 175/336 |
| 2,520,517 | 8/1950 | Taylor | 175/336 |
| 2,901,222 | 8/1959 | Pease, Jr. | 175/329 |
| 3,055,443 | 9/1962 | Edwards | 175/330 |
| 3,066,749 | 12/1962 | Hildebrandt | 175/336 |
| 3,106,973 | 10/1963 | Christensen | 175/330 |
| 3,174,564 | 3/1965 | Morlan | 175/330 |
| 3,269,469 | 8/1966 | Kelly, Jr. | 175/336 |

*Primary Examiner*—James A. Leppink
*Attorney, Agent, or Firm*—Christie, Parker & Hale

[57] ABSTRACT

A rock bit for recovering core samples is described, along with variations for drilling oil wells or the like. In each of these embodiments a plurality of diamond cutters are mounted on the bit body for cutting rock by a shearing action. Each diamond cutter is in the form of a thin diamond plate bonded to a carbide slug that is inserted into the bit body. Means are also provided for limiting the depth of penetration of the diamond cutters into the rock formation being drilled preferably in the form of rolling cone cutters having a plurality of carbide insects protruding from their surfaces. The protrusion of the carbide inserts from the surface of the cutter cones is less than the length of the diamond plate. This limits the depth that the diamond can penetrate in the rock and inhibits damage. Typically the diamond cutters are mounted for cutting one portion of the hole area by shearing action and the rolling cone cutters are mounted for cutting another portion of its area by chipping-crushing action.

41 Claims, 7 Drawing Figures

DIAMOND CUTTER ROCK BIT WITH PENETRATION LIMITING

BACKGROUND

Two principal types of rotary drill bits are employed for rock drilling for oil wells, recovering core samples, and the like. One type uses rolling cone cutters mounted on the body of the drill bit so as to rotate as the drill bit is rotated. The angles of the cones and the bearing pins on which they are mounted are aligned so that the cones essentially roll on the bottom of the hole without gross slippage. Sometimes the cones are deliberately skewed to enhance gouging action in some rock types. One type of rolling cone cutter is an integral body of hardened steel with teeth formed on its periphery. Another type has a steel body with a plurality of tungsten carbide or similar inserts of high hardness that protrude from the surface of the body somewhat like small knobs. As the rolling cone cutters roll on the bottom of the hole being drilled, the teeth or carbide inserts apply a high compressive load to the rock and fracture it. The cutting action in rolling cone cutters is typically by a combination of crushing and chipping. The cuttings from a rolling cone cutter are typically a mixture of moderately large chips and fine particles.

Another basic type of rotary rock drill is a drag bit. Some of these have steel or hard faced teeth, but primarily they are set diamond drills. Typically in a set diamond drill the face is coated over much of its area with a hard material in which are embedded or "set" numerous diamonds. The diamonds protrude from the surface of the matrix a short distance (typically no more than a few hundredths of an inch in a new drill) and when the drill is used they rub on the rock, abrading shallow tracks and cutting primarily by a combination of compressive and shearing action. In most cases set diamonds, due to their small size, bear loads of about 100 to 200 pounds per diamond. In many set diamond bits, rounded diamonds are selected to give best resistance to compressive forces. The depth of penetration of the set diamonds is ordinarily determined by the weight on the bit, the quantity of diamonds on the bit and heat limitations.

Combinations of drag bits and rolling cone bits have been proposed. For example, U.S. Pat. No. 3,174,564 to E. A. Morlan for a "Combination Core Bit", has a cylindrical crown encrusted with set diamonds for cutting an annulus around a core. The set diamonds protrude from the matrix tiny distances in the conventional manner. A plurality of rolling cone cutters with carbide inserts are mounted in special recesses around the cylindrical crown for cutting an outer annulus of considerably greater area than the inner annulus cut by the diamonds. The set diamonds are used for their fine abrasive action in trimming the core and thereby minimizing breakage. Most of the cutting is done by the rolling cone cutters.

In conventional set diamond drills the depth of penetration of each diamond is only a few mils but rapid penetration rates can be obtained because of the large number of diamonds set on the face of the bit. Penetration rate is limited so that there is minimal wear of the matrix in which the diamonds are mounted. Rock drilling by set diamond drills is analogous to grinding with a grinding wheel made of small abrasive particles. The cuttings from a set diamond bit are in the form of extremely fine particles.

U.S. Pat. Nos. 1,731,262 to Phipps and 2,054,277 to Wright also have combinations of drag bits and rolling cone cutters. These bits have large steel drag teeth and steel rolling cone cutters hence are rather limited in application. Only very soft formations can be cut efficiently with such a design and they are impractical for deep wells where it is desirable to cut long distances before changing the rock bit.

Recently a new product has become available that permits a new type of rock bit. The product is a diamond cutter described in greater detail hereinafter. Broadly, the diamond cutter has a wafer or plate of diamond about 0.020 inch thick and 0.33 inch in diameter bonded to a tungsten carbide slug. This product was developed by General Electric and is commercially available under their trademark COMPAX. The slug can be inserted in a drill bit body so that the diamond plate protrudes therefrom at the proper angle for cutting rock. The cutting action by these diamond cutters is by shearing the rock much in the manner of conventional machining with cutting tools rather than the grinding-like action of conventional set diamond drills. Instead of finely ground material, much of the cut rock emerges from the drilled hole as appreciable size chips, somewhat like those from a rolling cone cutter.

A rock drill having such diamond cutters protruding from its face has been built by General Electric. Such bits have demonstrated good penetration rates in a variety of rocks and very long lifetime. Some problems have been noted under adverse conditions due to breakage of the diamond cutters. This appears to be a particular problem in interspersed formations where there are sudden changes between relatively soft and relatively hard types of rock, and most particularly when the dip of the interspersed formation is steep relative to the hole being drilled.

When a rotary rock bit is being used, a selected weight is applied to it by the weight of the drill string in the hole above it, as controlled by the drilling rig. The weight applied to the bit is adjusted depending upon the type of rock being drilled. Rapid drilling weight adjustment to account for differences in rock types in interspersed formations is not feasible. This means that penetration may be too much in one rock type or too little in the other. This problem is serious in ordinary set diamond drills but is not significant in rolling cone drills. It also can be significant in drills with diamond cutters where a limited number of cutters are engaging the rock during drilling.

Drills with diamond cutters appear particularly sensitive to overloading which can break the diamond cutters. Sudden changes in rock hardness may also apply an impact load on the diamond cutter and initiate failure. It may, therefore, be necessary in interspersed formations to use a drilling load that is appreciably less than optimum for best penetration to protect the bit with diamond cutters. It is desirable to provide a means for protecting the diamond cutters during drilling to inhibit damage to the diamond cutters so that maximum penetration rates can be achieved.

BRIEF SUMMARY OF THE INVENTION

There is, therefore, provided in practice of this invention according to a presently preferred embodiment, a rock bit having a bit body with a plurality of diamond cutters mounted thereon and protruding from the surface in positions that provide a cutting edge on each diamond cutter for shearing rock upon rotation of the bit. Means are also provided for limiting maximum penetration of the diamond cutters into the rock.

DRAWINGS

These and other features and advantages of the present invention will be appreciated as the same becomes better understood by reference to the following detailed description of presently preferred embodiments wherein.

DESCRIPTION

Figure 1:
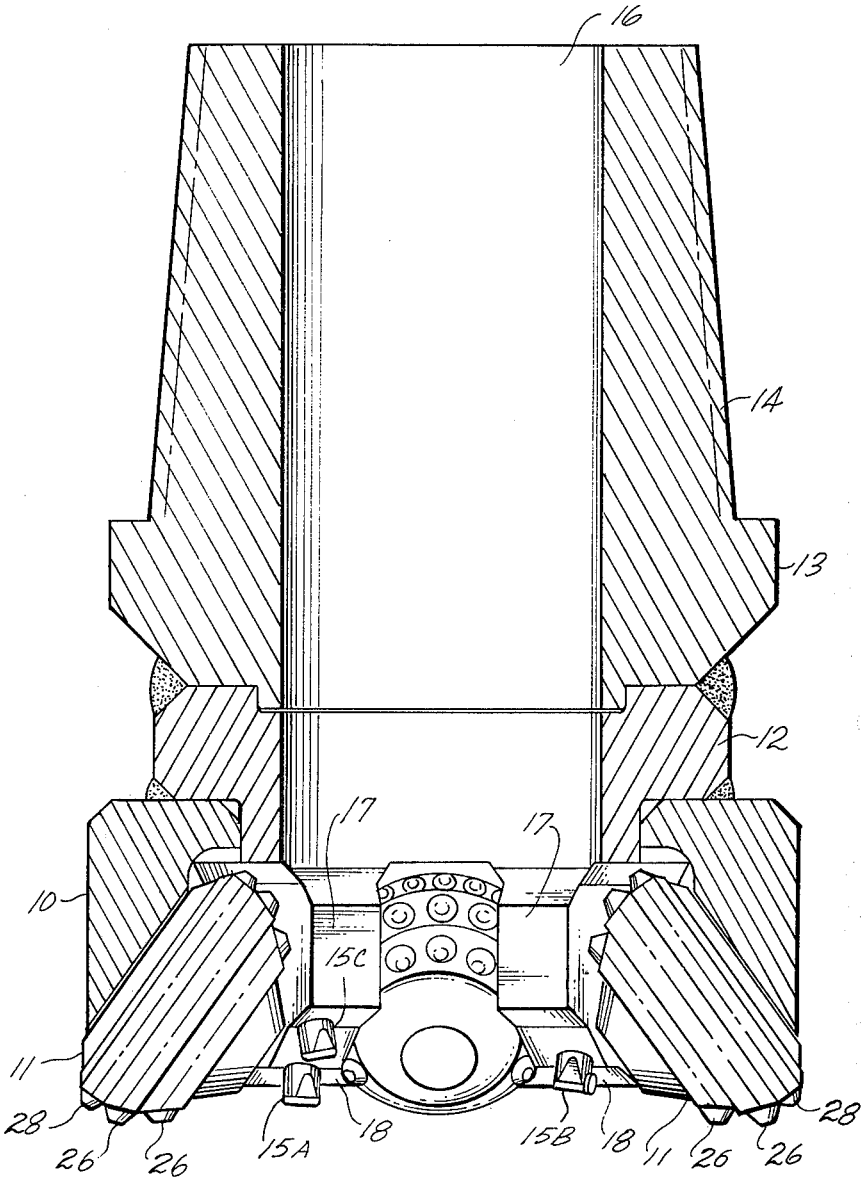
FIG. 1 is a longitudinal cross section of a drill bit constructed according to principles of this invention.
Figure 2:
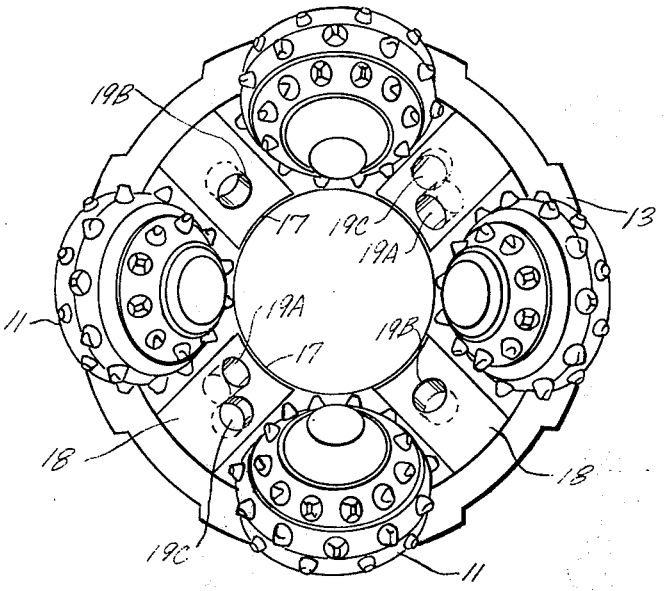
FIG. 2 is an end view of the drill bit of FIG. 1.

FIG. 1 is a longitudinal cross section and FIG. 2 is an end view of a core bit making application of both diamond cutters and rolling cone cutters. In FIG. 2 the bit is ready for about the last stage of assembly, namely, insertion of the diamond cutters. They are omitted from this view to show the alignment of the holes in which the cutters are mounted.

As best seen in FIG. 1, it is convenient to make the bit body in several pieces and weld it together during assembly. Four steel legs 10 having a general L-shape are machined and heat treated. Each of these legs includes a conventional bearing pin which cannot be seen in FIG. 1 since rolling cone cutters 11 are mounted on the respective pins in the conventional manner. The rolling cone cutter legs 10 are welded on a lower bit body 12 after it has been machined. A pin blank 13 is then welded on to the body 12 and a conventional oil well thread 14 is machined on the blank. The body and pin blank have a hollow axial passage 16 which, during use, receives a conventional core catcher for retrieving cores cut by the core drill. At the lower end of the passage and above the level where cutting occurs there are four surfaces 17 collectively defining a cylinder having only a slightly larger diameter than the diameter of the core being made by the bit. These surfaces 17 are on the interior of four arms 18 spaced between the four rolling cone cutters 11. These arms support diamond cutters 15 (FIG. 1).

The diamond cutters are mounted in each of six flat bottomed holes 19 (FIG. 2) drilled in the ends of the arms 18. The holes are labeled A, B and C to indicate the row of cutting for each diamond cutter as further described hereafter. Each hole 19 is formed at an angle to the axis of the bit for supporting the respective diamond cutter in its proper position. This is indicated in FIG. 2 by showing the outer end of the hole in solid lines and also showing the bottom of the hole with the hidden portions in dotted lines. The specific angular relationships are not readily determined from this drawing since the ends of the arms 18 in which the holes are drilled are not planar, as seen in FIG. 1. The angular relation between the holes for the diamond cutters and the axis of the bit is better seen in FIG. 3 which is a semi-schematic cross section indicating the paths of the cutters.

Figure 4:
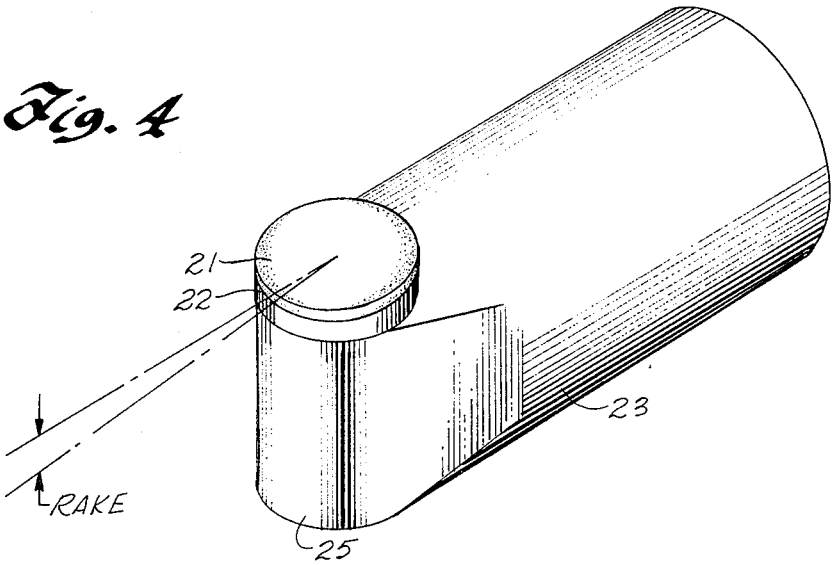
FIG. 4 is a perspective view of a diamond cutter.

FIG. 4 is a perspective view of one of the COMPAX diamond cutters available from General Electric. The diamond is present as a plate 21 about 0.020 inch thick and about 0.33 inch diameter. This is not a single crystal diamond but is a diamond-to-diamond, bonded, polycrystalline material. The diamond plate 21 is bonded to a tungsten carbide cylinder 22 that is in turn brazed to a tungsten carbide slug 23. The carbide slug has a cylindrical base about 0.503 inch diameter to give a tight press fit in a ½ inch diameter hole in the bit. Such a press fit is the sole mounting required for such a diamond cutter.

The short carbide cylinder 22 is supported on the slug 23 by a buttress like portion 25 supporting the end of the carbide cylinder, except a narrow rim about 0.01 inch wide around half the perimeter of the carbide cylinder. This prevents portions of the carbide slug from interfering with cutting action by the diamond plate 21. The carbide cylinder 22 and hence the diamond plate 21 are tilted rearwardly (downwardly in FIG. 4) relative to the axis of the slug at an angle in the range of from about 5° to 15° so that in use the rake angle or angle of attack of the diamond plate on the rock is about −5° to −15°. Rake angles from about 0° to about −20° appear to be suitable. COMPAX diamond cutters with carbide slugs are available in a few lengths between about 0.9 and 1.155 inch to accommodate various desired extensions of the diamond plate from the body of the bit in which the plug is inserted or to accommodate various hole depths.

The rolling cone cutters 11 are of a generally conventional type. In this embodiment each cutter has either two or three inner rows of tungsten carbide inserts 26. Each rolling cone cutter also has an outermost row of carbide inserts 28 generally referred to as the gage row. The inserts in the outermost row are at the periphery of the hole being drilled and maintain its full gage. The spacing of the inserts within the rows 26 and 28 on individual rolling cone cutters may be varied in the conventional manner to minimize tracking and maximize cutting efficiency. The inner rows of inserts 26 on the various rolling cone cutters are at different radial distances from the axis of the bit. Thus, five "grooves" are cut by the inner rows and one by the gage row so that in effect six different annular grooves are cut in the bottom of the hole as the drill is operated. A variety of such patterns can be provided as are well known to those skilled in the art for assuring full face cutting on the end of the hole being drilled.

Figure 3:
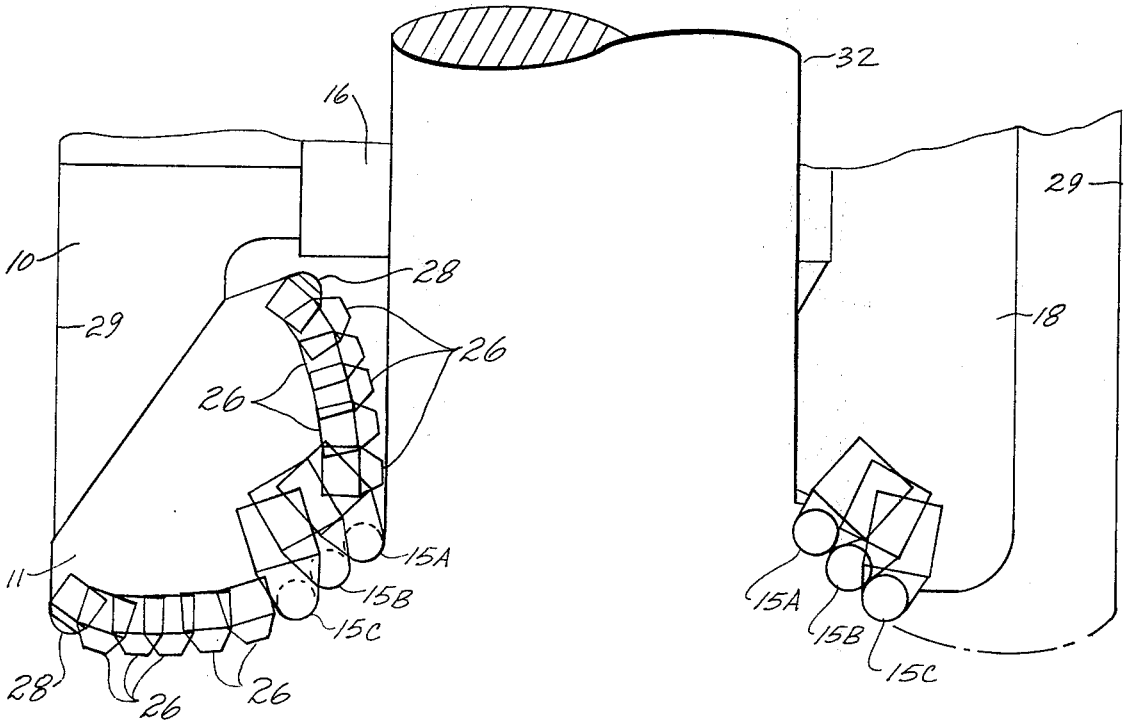
FIG. 3 is a semi-schematic illustration of the drill bit indicating the relationship between the diamond cutters and rolling cone cutters thereon.

FIG. 3 is a schematic illustration for indicating the location of the various grooves cut by the inserts in the rolling cone cutters illustrated in FIGS. 1 and 2 and by the diamond cutters. In the left side of this view the cutting elements are projected around the axis of the bit as if all lay in a common radial plane. This suggests considerable overlap of the mounting portions of the cutting elements that is not present in the actual structure of the bit. The purpose is to indicate the relative locations of the cutting portions.

In this view the gage row of inserts 28 is seen to be adjacent the wall 29 of the hole being drilled. The balance of the carbide inserts 26 in the inner rows of the rolling cone cutters can be seen to cut a major portion of the annulus between the wall 29 of the hole and a cylindrical core of rock 32 entering the axial passage through the bit. The three rows of diamond cutters in this embodiment are labeled 15A, 15B and 15C in FIG. 3, corresponding to the holes 19A, 19B and 19C in FIG. 2. It will be noted that whereas there are a large number of carbide inserts in each of the rows 26 and 28 cut by the rolling cone cutters, there are only two diamond cutters 15 in each of the rows A, B and C.

The innermost pair 15A of diamond cutters cuts a path through the rock adjacent the core 32 and thus trims the core to gage. The other two pairs 15B and 15C of diamond cutters cut the balance of the annulus between the innermost diamond cutter 15A and the innermost row 31 of carbide inserts. Although the various inserts and diamond cutters essentially cut in a plurality of concentric grooves on the bottom of the hole, they are arranged to cut in a profile that is an essentially continuous or smooth curve extending across the annulus from the core to the gage of the hole. Other arrangements can be provided with the diamond cutters leading or trailing the cutting by the carbide inserts but the illustrated arrangement is preferred for minimizing cracking of the core. Further, by avoiding a "step" in the bottom of the hole, formation of excessively large chips is avoided. Large chips from the edge of such a step may cause impact loads on the diamond cutters, leading to failure. This principle is applicable whether a core is being formed or the full face of the hole is being drilled.

It will be noted that the curvature provided in the bottom of the hole in the arrangement illustrated in FIG. 3 is a substantially smooth curve blending rather gradually into the core 32 in the center and somewhat less gradually into the wall 29 of the hole. This curvature without a sharp transition between the annulus being cut and the core minimizes locations of stress concentration and further helps avoid breakage of the core.

It is an important function of the rolling cone cutters to limit the depth of penetration by the diamond cutters. Depth of penetration of the diamond cutters should be limited to no more than about three-fourths of the length of the diamond plate. In this context, the length of the plate is considered to be its extent in the direction parallel to the hole axis. Since the available COMPAX diamond plates are circular and about 0.33 inch diameter, it is preferred that the depth of penetration be no more than about 0.25 inch. If penetration exceeds about three-fourths the length of the diamond plate significant wear of the carbide slug may occur, weakening it to the point that it may fail. Further, with excessive penetration, drilling in interspersed formations can lead to high impact loads on the diamond cutters and failure. Preferably the depth of penetration of the diamond plate is appreciably less than three-fourths of its length so that life time is determined by wear of the diamond rather than by the possibility of fracture. Preferably the depth of penetration is no more than about 0.1 inch to minimize impact loading on the diamond cutter in the case of interspersed formations.

The depth of penetration of the diamond cutters is limited by the protrusion of the carbide inserts from the body of the rolling cone cutters. The carbide inserts can penetrate into the rock during drilling no more than their protrusion from the surface of the rolling cone cutter. The actual depth of penetration is ordinarily less than the full protrusion of the carbide inserts since there is interference by fragmented rock. Thus, by limiting the protrusion of the carbide inserts from the rolling cone cutters to a fraction of the length of the diamond plate, the depth of penetration of the diamond plate is also limited.

In the arrangement hereinabove described and illustrated, the length of the diamond plate is about 0.33 inch. Protrusion of the carbide inserts from the rolling cone cutters is about 0.25 inch. Because of interference during drilling operations, the maximum depth of penetration of the diamond plates into rock being cut is less than the full length of the carbide inserts. Most typically, the penetration by the diamond plate is no more than about one-third of their length.

It is also preferred that the protrusions of the carbide inserts on the rolling cone cutters be more than about one-fourth of the length of the diamond plate. If the protrusion is less than this amount, cutting by the diamond cutters may be unduly limited so that they do not work to full capacity and maximum penetration rate cannot be obtained.

Figure 5:
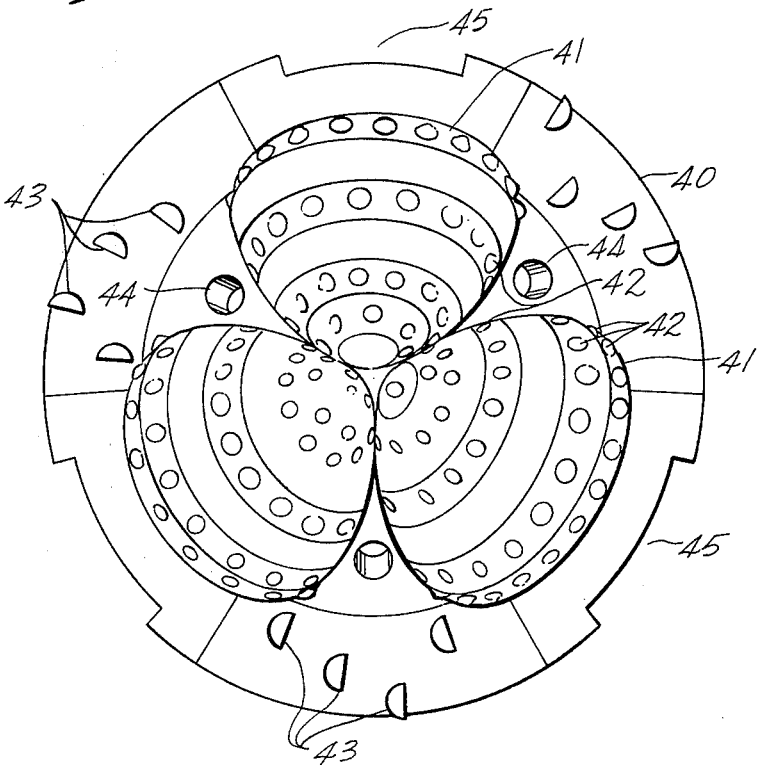
FIG. 5 is a semi-schematic end view of another embodiment of drill bit constructed according to principles of this invention.

Practice of this invention with limitation of penetration of diamond cutters is not restricted to the core drill hereinabove described and illustrated. FIG. 5, for example, illustrates in end view an embodiment of rock bit for drilling a hole without a core using both rolling cone cutters and diamond cutters. In this embodiment, the center portion of the hole is drilled by rolling cone cutters 41 and the surrounding annulus is drilled by diamond cutters.

Thus, three conventional rolling cone cutters 41 are mounted in the center portion of a drill bit. The nose ends of these cutters are arranged to provide drilling to the center of the hole in the conventional manner. In essence the arrangement of the three rolling cone cutters is the same as in a conventional three-cone rock bit. Each of the rolling cone cutters has a plurality of carbide inserts 42 protruding from its surface in a series of rows. Preferably these rows and the inserts within them are staggered in a conventional manner to assure cutting over the full face of the bit and absence of tracking.

The bit body 40 extends radially outwardly from the path cut by the rolling cone cutters. On this portion of the bit body there are a plurality of diamond cutters 43 mounted to sweep out a number of circular paths for cutting rock in the annulus beyond the outside row of inserts on the cutter cones. The diamond cutters in this embodiment are like those hereinabove described and illustrated in FIG. 4 but are illustrated schematically simply as semi-circles to indicate the direction of cutting. In each case the diamond plate faces in a circumferential direction around the bit. Fluid jets 44 are provided in the bit body for directing drilling mud into the regions around the various cutters for removing rock chips from the hole. "Junk slots" 45 or clearance may be provided around the body of the bit in a conventional manner to accommodate such flow.

In rock drilling with rolling cone cutters, maintaining the gage of the hole is often one of the problems encountered. For this reason, typical carbide insert type rock bits have a full row of inserts in the gage row on each rolling cone cutter and the inserts are typically closely spaced to best assure a full gage hole throughout the life of the bit. The gage row is subject to considerable wear because of drag of the carbide inserts on the wall of the hole. Carbide inserts are effective in the chipping-crushing action in the bottom of the hole and less effective in drag on the sides. Wear on the gage row inserts can cause tight holes, giving later difficulties in installing casing or running new tools in the hole.

Many of these problems are avoided in an embodiment as illustrated in FIG. 5 since the outermost row of inserts on the rolling cone cutters 41 are not relied upon to define the gage of the hole. The hole gage is assured by the outermost row of diamond cutters 43 which are appropriately designed for drag cutting as hereinabove described. Since these diamond cutters are provided on a relatively large diameter portion of the bit, a substantial number may be used so that wear on each is minimized and accidental damage to some of the inserts will not deleteriously affect operation of the bit. If desired a single row of diamond inserts may be provided on the gage of an otherwise conventional three cone bit. Thus the hole can essentially be reamed to full gage by the diamond cutters while the main downhole cutting is by rolling cone cutters.

In the illustrated arrangement, the bit body 40 has three legs extending down-hole so that the diamond cutters 43 form a cut that has a profile that is essentially a continuation of the profile made by the rolling cone cutters 41. Thus the bottom of the hole is in the form of a series of concentric grooves without an extensive step therebetween. This minimizes the formation of oversized chips that do not clear the face of the tool promptly and result in regrinding with consequent loss of efficiency or possible damage to the diamond cutters. If desired, the diamond cutters can lead or trail the rolling cone cutters so as to cut at a different elevation in the hole.

The inserts 42 on the rolling cone cutters protrude from the face of the respective cutter a distance less than the length of the diamond plate on the diamond cutters. This limits the extent of penetration of the diamond cutters as hereinabove described. The proportions between the protrusion of the carbide inserts and the length of the diamond plates is preferably the same as hereinabove described. By providing such means for limiting penetration of the diamond cutters prolonged life is obtained.

Figure 6:
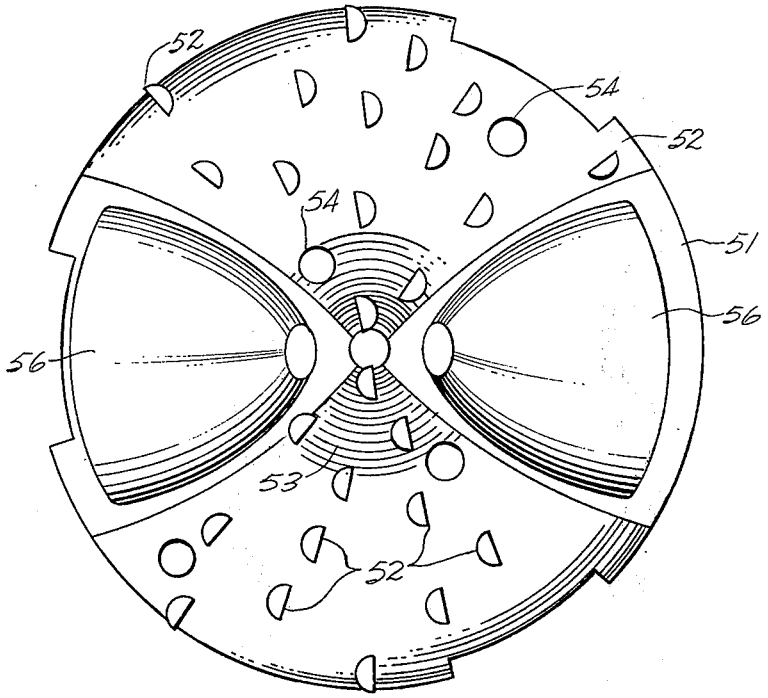
FIG. 6 is a semi-schematic end view of another embodiment of drill bit constructed according to principles of this invention.

FIG. 6 illustrates another embodiment of hole drilling bit constructed according to principles of this invention. As illustrated in this embodiment, the bit body 51 has a plurality of diamond cutters 52 mounted on the face thereof in an array that provides cutting over substantially the full face of the drill bit. A relatively small hole 53 is left in the middle since drag cutting is relatively inefficient near the centerline of the bit. A small core of rock passes through the hole 53 to a conventional core breaker (not shown) in the bit body.

The face of the drill bit illustrated in FIG. 6 is not planar but preferably more resembles the surface of a donut or torus. That is, the face is relatively recessed near its periphery and near the hole 53 through the center. The intermediate portion is relatively raised or nearer as seen in FIG. 6. Since each of the diamond cutters extends from the bit body the same distance, the hole that is cut as the bit is used is approximately the complement of the lower face. Such a configuration appears desirable for best mud circulation from jets 54 during drilling operations.

As mentioned above, penetration of the diamond cutters into the rock being cut should be limited to prolong their life. There are, therefore, provided a pair of generally conical rollers 56 mounted for rotation on the bit body with minimum slippage on the bottom of a hole to minimize wear on the rollers. The rollers 56 are hardened steel or may be faced with a hard facing material if desired. They do not have carbide inserts on their faces but are essentially smooth and configured to approximately conform to the shape of the bottom of the hole being drilled.

The surfaces of the rollers are recessed slightly below the surface cut by the diamond cutters 52 so that during normal operations when the diamond cutters are penetrating the rock formation by an acceptable amount, the rollers do not come into direct contact with the uncut rock. If, however, there is an accidental overload on the drill bit for the particular rock formation being drilled at that time such that the diamond cutters would overpenetrate, the rollers come in contact with the bottom of the hole and limit the penetration. Excess loads applied to the rock bits are carried by the rollers rather than the diamond cutters. This protects the diamond cutters from accidental damage and significantly prolongs the life of the drilling bit, particularly when drilling in interspersed formations that are particularly troublesome drilling for this type of bit. Preferably the rollers 56 are recessed about three-fourths of the length of the diamond plates on the diamond cutters. This assures that the diamond plates do not penetrate more than this amount and in practice they penetrate less due to interference between rock fragments and the rollers.

In an embodiment as illustrated in FIG. 6 a hard-faced "skid" area may sometimes be substituted for the rollers 56. Such may be used where overloading is expected to be intermittent and infrequent. Such skids have high friction which may cause considerable power waste and generate high temperatures at the cutting surfaces. Rollers for limiting penetration of the drag cutters are therefore preferred.

Figure 7:
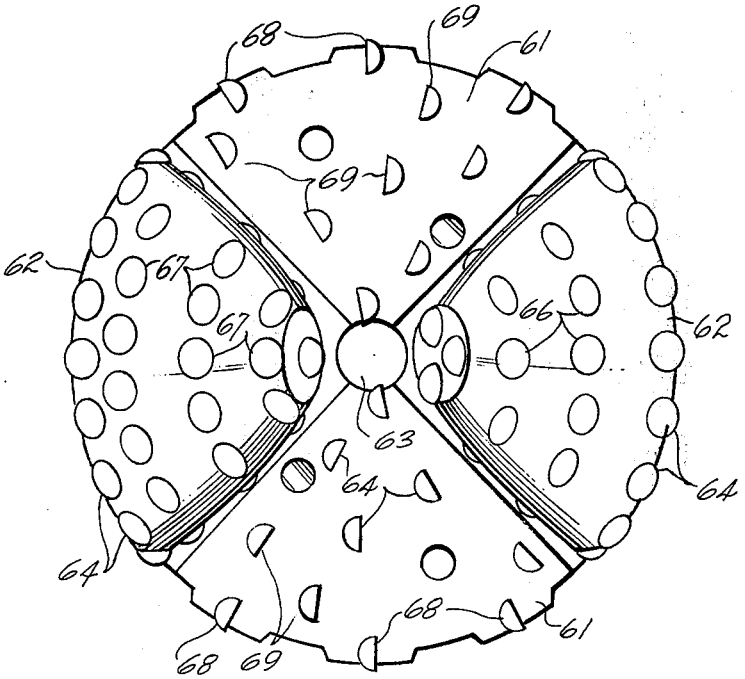
FIG. 7 is a semi-schematic end view of another embodiment of drill bit.

FIG. 7 is a semi-schematic end view of another embodiment of rock drill bit constructed according to principles of this invention. This embodiment differs from those of FIGS. 1 to 5 in that diamond cutters and carbide inserts on rolling cone cutters drill portions of the bottom of a hole that overlap, that is, at least part of both the diamond cutters and carbide inserts follow the same annular paths on the bottom of a hole being drilled.

In this embodiment, the bit body has a pair of depending arms 61 for mounting diamond cutters. Between the arms there are mounted a pair of tungsten carbide insert rolling cone cutters 62. An axial hole 63 in the bit body leads to a conventional core breaker (not shown) so that the complete cross section of the hole is drilled. Each of the rolling cone cutters has a row of tungsten carbide inserts 64 in a gage row that assures that a full gage hole is drilled. One of the rolling cone cutters has two additional rows of tungsten carbide inserts 66 spaced inwardly from the gage row. The other of the rolling cone cutters has three additional rows of tungsten carbide inserts 67 spaced inwardly from the gage row. Each of these rows of carbide inserts drills in an annular path on the bottom of the hole as the drill bit is rotated. The two rows of carbide inserts 66 on the first rolling cone are positioned so that the annular paths that they drill are interspersed between the annular paths drilled by the three rows of carbide inserts 67 on the other rolling cone. Thus, five annular paths are drilled inwardly from the outermost gage row. Such an arrangement permits the carbide inserts to be somewhat spaced apart for greatest strength of the cone and still provide for drilling over the full bottom of the hole.

The bottom of each of the arms 61 has a profile approximately the same as the profile of the cutter cones 62. Each arm has three diamond cutters 68 mounted for cutting at the gage of the hole being drilled. These diamond cutters are illustrated schematically in FIG. 7 in the same manner as FIGS. 5 and 6 but it will be appreciated that they are of the type hereinabove described and illustrated in FIG. 4. The gage diamond cutters 68 drill in the same annular path as the gage carbide inserts 64 on the two rolling cone cutters.

Each arm also has a plurality of additional diamond cutters 69 spaced inwardly from the gage row 68. These additional diamond cutters are positioned in annular paths corresponding to the additional annular paths drilled by the carbide inserts 66 and 67 in the rolling cone cutters. Thus, the annular paths on the bottom of a hole are drilled by both carbide inserts and diamond cutters.

As mentioned above, carbide inserts on rolling cone cutters conventionally drill by either of two actions. When the axis of the cone intersects the axis of the rock drill the principal drilling action is due to crushing of the rock by the carbide inserts due to the heavy weight applied to the drill bit. When the axis of a cutter cone is offset slightly from the axis of the drill bit there is some sliding or skidding action by the cone and an appreciable amount of gouging action during drilling. The gouging action of an offset bit is desirable in relatively softer rock. The primary crushing action of a non-offset drill bit is ordinarily preferred in relatively harder rock.

Either an offset or non-offset roller for primarily gouging or crushing action, respectively, can be used in the arrangement of FIG. 7. In either case the path that is drilled by each row of carbide inserts is rough since the loads are applied intermittently on the rock.

The diamond cutters cut by a shearing action as they are dragged across the rock. Thus a groove cut by a diamond cutter is ordinarily rather smooth except as chips from the rock may leave a slightly roughened surface.

The diamond cutters in the embodiment of FIG. 7 are arranged in the same annular paths as the carbide inserts on the rolling cone cutters. Thus, the rough groove formed by the carbide inserts is scraped smooth by the diamond cutters. This reduces the load on the diamond cutters for a given volume of rock removed from the bottom of the hole. Further, it minimizes or eliminates the possibility of "tracking" by the rolling cone cutters where the carbide inserts repeatedly contact the same point on the bottom of the hole and drill inefficiently. Thus, a combination of diamond cutters and rolling cone cutters on a rock drill where both drill in the same profile on the bottom of a hole can be more effective in some formations than either diamond cutters or rolling cone cutters alone.

In the embodiment of FIG. 7 substantially the entire bottom of the hole is drilled by both carbide inserts and diamond cutters. If desired, either can be arranged so that different portions are drilled, with only a portion of the bottom of the hole being drilled by both carbide inserts and diamond cutters.

The carbide inserts on the rolling cone cutters in the embodiment of FIG. 7 protrude from the surface thereof a distance less than the full length of the diamond cutters. Thus, as described above the depth of penetration of the diamond cutters is limited to minimize wear on the carbide slug mounting the diamond plate and minimizing the impact loading on the diamond. Criteria as set forth above are employed whether the carbide inserts and diamond cutters drill in similar or different portions of the bottom of a hole.

Although limited embodiments of drill bits having diamond cutters with means for limiting penetration of the diamond cutters have been described and illustrated herein, many modifications and variations will be apparent to one skilled in the art. Thus, for example, although the drag cutters are described herein in terms of the carbide slugs bearing a diamond plate currently available commercially, other variations of drag cutter are also suitable. The drag cutter may have other configurations instead of the essentially cylindrical end provided by the diamond plates.

In some embodiments tungsten carbide or other hard drag cutters may be used with depth of penetration limited by rollers better capable of carrying heavy axial load. Use of means for limiting penetration is particularly applicable when the drag cutters are hard and therefore wear resistant, yet subject to impact or failure upon over-penetration. This invention has essentially no applicability in steel drag bits for soft formations.

If desired, one may use diamond cutters near the center of the hole being drilled (with or without a core) and on the hole gage with carbide insert rolling cone cutters drilling an annulus therebetween. Many other modifications and variations will be apparent to one skilled in the art, and it is therefore to be understood that the invention may be practiced otherwise than as specifically described.

What is claimed is:

1. A rotary rock bit comprising:

a bit body having a longitudinal axis of rotation;

a plurality of diamond cutters each having a cutting edge protruding from the bit body for engaging the bottom of a hole being drilled at a selected rake angle for shearing rock in a plurality of paths concentric with the axis of the bit body; and means for limiting depth of penetration of the diamond cutters into the rock to less than the distance of protrusion of the diamond cutters from the bit body comprising a plurality of rolling cone cutters mounted on the bit body for rotation upon rotation of the bit body, each rolling cone cutter comprising a plurality of carbide inserts protruding from the surface of the rolling cone cutter a distance less than the distance of protrusion of the diamond cutters from the bit body in the axial direction for engaging the bottom of the hole being drilled and for crushing or gouging of rock in a path concentric with the portion of the hole drilled by the diamond cutters.

2. A rock bit as defined in claim 1 wherein the rolling cone cutters are mounted relatively nearer the axis of the bit body and the diamond cutters are mounted relatively nearer the periphery of the bit body for drilling an annulus around the portion of a hole drilled by the rolling cone cutters.

3. A rock bit as defined in claim 1 wherein the diamond cutters are mounted relatively nearer the axis of the bit body and the rolling cone cutters are mounted relatively nearer the periphery of the bit body for drilling an annulus around the portion of a hole drilled by the diamond cutters.

4. A rock bit as defined in claim 3 wherein the bit body further comprises an axial core receiving passage, and wherein the diamond cutters are mounted on an end portion of the rock bit body around the axial passage for drilling an annular portion of a hole between a rock core and the portion of the hole drilled by the rolling cone cutters.

5. A rock bit as defined in claim 1 wherein the diamond cutters are mounted on the bit body in a position such that there is a substantially smooth curve between the profile cut by the diamond cutters and the profile cut by the rolling cone cutters so that the bottom of a drilled hole comprises essentially a continuous surface of concentric grooves without a step shoulder therebetween.

6. A rock bit as defined in claim 1 wherein each diamond cutter comprises:

a slug inserted in the bit body; and a diamond plate bonded to the slug, the diamond plate facing in a circumferential direction relative to the axis of the bit body for shearing rock upon rotation thereof.

7. A rock bit as defined in claim 6 wherein the carbide inserts on the rolling cone cutters protrude from the surface thereof more than about one-fourth the length of the diamond plates on the diamond cutters and less than the full length thereof.

8. A rock bit as defined in claim 7 wherein the carbide inserts protrude from the surface of the rolling cone cutters no more than about three-fourths of the length of the diamond plates.

9. A rock bit as defined in claim 1 wherein the bit body comprises:

a plurality of cone cutter legs extending downwardly therefrom and wherein a rolling cone cutter is mounted on each of the cone cutter legs;

an axial passage for receiving a core; and a plurality of diamond cutter arms extending downwardly therefrom and interspersed between the cone cutter legs, and wherein each of the diamond cutter arms has at least one diamond cutter mounted thereon for drilling an annulus between the axial passage and a portion of rock drilling by the rolling cone cutters.

10. A rock bit as recited in claim 1 wherein the selected rake angle is in the range of from about 0° to about −20°.

11. A rotary rock bit comprising:

a bit body;

a plurality of diamond cutters on the bit body each with a cutting edge extending from the bit body a selected distance for engaging the bottom of a hole being drilled at a selected rake angle and shearing rock during drilling; and means on the rock bit for engaging the rock being drilled and limiting depth of penetration of the diamond cutters into rock during drilling to a depth of more than about one-fourth and less than about three fourths of the length of the diamond cutters extending from the body.

12. A rock bit as recited in claim 11 wherein the selected rake angle is in the range of from about 0° to about −20°.

13. A rock bit as defined in claim 11 wherein the means for limiting depth of penetration comprises a plurality of rolling cone cutters mounted on the bit, each of the rolling cone cutters comprising a plurality of carbide inserts protruding from the surface thereof a distance less than the length of the diamond cutters for engaging rock during drilling operations for drilling a portion of the bottom of a hole being drilled, the balance of the bottom of the hole being drilled by the diamond cutters.

14. A rock bit as defined in claim 13 wherein the rolling cone cutters and the diamond cutters are mounted so that the profile drilled by the rolling cone cutters is essentially a smooth continuation of the profile drilled by the diamond cutters without a substantial step therebetween.

15. A rock bit as defined in claim 13 wherein the rolling cone cutters and the diamond cutters are mounted so that the profile drilled by the rolling cone cutters is essentially the same as the profile drilled by at least a portion of the diamond cutters.

16. A rock bit as defined in claim 11 wherein the means for limiting depth of penetration comprises a plurality of rollers mounted on the bit for engaging rock during drilling operations to limit penetration of the diamond cutters.

17. A rock bit as defined in claim 16 wherein the rollers have a profile similar to a profile cut by a plurality of the diamond cutters, said rollers rotating with the bit body in essentially the same annular track as the selected plurality of diamond cutters, the surface of the rollers trailing the diamond cutters in a direction along the axis of a hole being drilled for engaging the bottom of the hole only upon maximum penetration of the diamond cutters.

18. A rock bit as defined in claim 16 wherein the rollers have a profile similar to a profile drilled by a plurality of the diamond cutters, said rollers rotating with the bit body in essentially the same annular path as a plurality of diamond cutters; and further comprising a plurality of carbide inserts protruding from the surface of the rollers a distance less than the length of the diamond cutters, at least a portion of the carbide inserts and diamond cutters being aligned in the same annular paths on the bottom of a hole drilled by the rock bit.

19. A rock bit as defined in claim 16 wherein each diamond cutter comprises:

a slug inserted in the bit body; and a diamond plate bonded to the slug, the diamond plate facing in a circumferential direction relative to the axis of the bit body for shearing rock upon rotation of the rock bit.

20. A rock bit as defined in claim 19 wherein the rollers each include a plurality of carbide inserts protruding from the surface of the respective roller less than the full length of the diamond cutters, and the rollers are mounted for drilling an annulus between the portion of the bottom of a hole drilled by the diamond cutters and the periphery of the hole.

21. A rock bit as defined in claim 20 wherein the bit body further comprises an axial passage for receiving a core of rock, and wherein the diamond cutters drill an annulus between a rock core and the portion of a hole drilled by the rollers.

22. A rock bit as defined in claim 19 wherein the rollers each include a plurality of carbide inserts protruding from the surface thereof a distance less than the length of the diamond cutters; and wherein the rollers are mounted on the bit body for drilling a central portion of a hole, and the diamond cutters are mounted on the bit body for drilling an annulus around the portion of the hole drilled by the rollers.

23. A rock bit as defined in claim 19 wherein each roller includes a plurality of carbide inserts protruding from the surface thereof an effective distance less than about three fourths of the length of the diamond cutters for limiting penetration thereof, and greater than about one-third the length of the diamond cutters.

24. A rotary rock bit comprising:

a bit body;

a plurality of diamond cutters each having a cutting edge;

means for mounting the diamond cutters on the bit body with the cutting edge protruding from the bit body at a selected rake angle for shearing rock upon rotation of the rock bit; and means mounted on the bit body for engaging rock being drilled and limiting depth of penetration of the diamond cutters into rock being cut to less than about three-fourths of the extent of protrusion of the cutting edge of the diamond cutter from the bit body.

25. A rock bit as defined in claim 24 wherein the means for limiting depth of penetration limits penetration to a depth in the range of from about one fourth to about three fourths of the extent of protrusion of the diamond cutters from the bit body.

26. A rock bit as recited in claim 24 wherein the selected rake angle is in the range of from about 0° to about −20°.

27. A rock bit as defined in claim 24 wherein the means for limiting the depth of penetration comprises a plurality of rolling cone cutters, each rolling cone cutter including a plurality of carbide inserts protruding from the surface thereof a distance less than the extent of protrusion of the diamond cutters from the bit body.

28. A rock bit as defined in claim 27 wherein the rolling cone cutters are mounted for drilling a portion of the bottom of a hole and the diamond cutters are mounted for drilling another portion of the bottom of a hole.

29. A rock bit as defined in claim 27 wherein the rolling cone cutters are mounted for drilling the same portion of the bottom of a hole as at least a portion of the diamond cutters.

30. A rotary rock bit comprising:

a bit body;

means at the upper end of the bit body for connecting the rock bit to a drill string;

a first plurality of arms extending downwardly from the bit body;

a plurality of diamond cutters mounted on the first plurality of arms for engaging rock being drilled at a selected rake angle and drilling a portion of the bottom of a hole;

a second plurality of legs extending downwardly from the bit body and interspersed between the first plurality of arms; and a rolling cone cutter mounted on each of the second plurality of legs, each rolling cone cutter comprising a plurality of carbide inserts protruding from the surface of the cutter cone a distance less than the protrusion of the diamond cutters from the arms for limiting penetration of the diamond cutters into rock being drilled to less than the protrusion of the diamond cutters from the arms.

31. A rock bit as defined in claim 30 wherein the rolling cone cutters are mounted for drilling an annulus around the portion of a hole drilled by the diamond cutters.

32. A rock bit as defined in claim 31 wherein the bit body further comprises a core receiving axial passage and wherein the diamond cutters drill an annulus between the passage and the annulus drilled by the rolling cone cutters.

33. A rock bit as defined in claim 30 wherein the diamond cutters are mounted for drilling an annulus around the portion of a hole drilled by the rolling cone cutters.

34. A rock bit as defined in claim 30 wherein the rolling cone cutters are mounted for drilling a portion of the bottom of a hole and the diamond cutters are mounted for drilling another portion of the bottom of a hole, and wherein the profile drilled by the diamond cutters is essentially a smooth continuation of the profile drilled by the rolling cone cutters without a substantial step therebetween.

35. A rock bit as defined in claim 30 wherein the rolling cone cutters are mounted for drilling at least a portion of the bottom of a hole and wherein the diamond cutters are mounted for drilling at least a portion of the bottom of a hole, and the portion drilled by each at least partly overlaps the portion drilled by the other.

36. A core bit comprising:

a bit body having an axial core receiving passage therethrough;

a plurality of diamond cutters mounted on the bit body around the passage for drilling an inner annulus of rock around a core, at least one of the diamond cutters having an edge for defining the gage of the core, each diamond cutter comprising a diamond plate bonded to a slug inserted in the bit body so that the diamond plate engages the rock at a selected rake angle; and a plurality of rolling cone cutters mounted on the bit body for drilling an outer annulus of rock around the inner annulus, each rolling cone cutter including a plurality of carbide inserts protruding from the surface of the respective cone a distance less than the length of the diamond plates for limiting depth of penetration of the diamond cutters to less than the length of the diamond plates.

37. A core bit as defined in claim 36 wherein the bit body comprises:

a first plurality of arms extending downwardly from the bit body, and wherein the plurality of diamond cutters are mounted on the first plurality of arms; and a second plurality of legs extending downwardly from the bit body and spaced between the first plurality of arms, and wherein a rolling cone cutter is mounted on each of the second plurality of legs.

38. A core bit as defined in claim 36 wherein the diamond cutters are mounted on the bit body for cutting a first profile on the bottom of a hole being drilled; and wherein the rolling cone cutters are mounted on the bit body for drilling a second profile on the bottom of a hole being drilled, the second profile being essentially a smooth continuation of the first profile without any substantial step therebetween.

39. A core bit as defined in claim 36 wherein the diamond cutters are mounted on the bit body for drilling the same profile on the bottom of a hole as the rolling cone cutters.

40. A rock bit as recited in claim 36 wherein the selected rake angle is in the range of from about 0° to about −20°.

41. A rotary rock bit comprising:

a bit body;

a plurality of diamond cutters mounted on the bit body for drilling a plurality of annular grooves in the bottom of a hole;

a plurality of rolling cone cutters mounted on the bit body for drilling at least a portion of the bottom of the hole, the portion drilled by the rolling cone cutters at least partly overlapping the portion drilled by the diamond cutters; and a plurality of carbide inserts protruding from the surface of each rolling cone cutter, the carbide inserts being in rows on the rolling cone cutters that drill annular grooves the same as at least a portion of the grooves drilled by the diamond cutters, and wherein the carbide inserts protrude from the surface of the rolling cone cutters a distance less than the protrusion of the diamond cutters from the bit body for limiting depth of penetration of the diamond cutters into the bottom of the hole to less than the length of protrusion of the diamond cutters from the bit body.

* * * * *